US009589716B2

(12) United States Patent
Doljack et al.

(10) Patent No.: US 9,589,716 B2
(45) Date of Patent: Mar. 7, 2017

(54) LAMINATED MAGNETIC COMPONENT AND MANUFACTURE WITH SOFT MAGNETIC POWDER POLYMER COMPOSITE SHEETS

(75) Inventors: Frank Anthony Doljack, Pleasanton, CA (US); Hundi Panduranga Kamath, Los Altos, CA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 1360 days.

(21) Appl. No.: 12/766,382

(22) Filed: Apr. 23, 2010

(65) Prior Publication Data

US 2011/0260825 A1 Oct. 27, 2011

(51) Int. Cl.

| | |
|---|---|
| ***H01F 27/24*** | (2006.01) |
| ***H01F 17/04*** | (2006.01) |
| *H01F 27/29* | (2006.01) |

(52) U.S. Cl.

CPC ..... *H01F 17/04* (2013.01); *H01F 27/24* (2013.01); *H01F 27/292* (2013.01); *H01F 2017/048* (2013.01); *Y10T 29/49073* (2015.01)

(58) Field of Classification Search

USPC ..... 336/65, 83, 192, 200, 232–234

See application file for complete search history.

(56) References Cited

U.S. PATENT DOCUMENTS

| | | | | |
|---|---|---|---|---|
| 2,391,563 | A | | 12/1945 | Goldberg |
| 3,255,512 | A | | 6/1966 | Lochner et al. |
| 4,072,780 | A | | 2/1978 | Zillman |
| 4,313,152 | A | | 1/1982 | Vranken |
| 4,498,067 | A | * | 2/1985 | Kumokawa et al. ..... 336/65 |
| 4,543,553 | A | | 9/1985 | Mandai et al. |
| 4,689,594 | A | | 8/1987 | Kawabata et al. |
| 4,750,077 | A | | 6/1988 | Amagasa |
| 4,758,808 | A | | 7/1988 | Sasaki et al. |
| 4,803,425 | A | | 2/1989 | Swanberg |
| 4,873,757 | A | | 10/1989 | Williams |
| 5,032,815 | A | | 7/1991 | Kobayashi et al. |
| 5,045,380 | A | | 9/1991 | Kobayashi et al. |
| 5,250,923 | A | | 10/1993 | Ushiro et al. |
| 5,257,000 | A | | 10/1993 | Billings et al. |
| 5,300,911 | A | | 4/1994 | Walters |
| 5,312,674 | A | | 5/1994 | Haertling et al. |
| 5,463,717 | A | | 10/1995 | Takatori et al. |
| 5,515,022 | A | | 5/1996 | Tashiro et al. |

(Continued)

FOREIGN PATENT DOCUMENTS

| | | |
|---|---|---|
| EP | 0655754 A1 | 5/1995 |
| EP | 0785557 A1 | 7/1997 |

(Continued)

OTHER PUBLICATIONS

International Search Report and Written Opinion of PCT/US2011/024714; Apr. 21, 2011; 14 pages.

(Continued)

*Primary Examiner* — Tuyen Nguyen

(74) *Attorney, Agent, or Firm* — Armstrong Teasdale LLP

(57) ABSTRACT

Miniaturized magnetic components for electronic circuit board applications include enhanced magnetic composite sheets facilitating increased direct current capacity and higher inductance values. The components may be manufactured using relatively simple and straightforward lamination processes.

28 Claims, 10 Drawing Sheets

(56) References Cited

U.S. PATENT DOCUMENTS 5,532,667 A 7/1996 Haertling et al.
5,572,180 A 11/1996 Huang et al.
5,664,069 A 9/1997 Takatori et al.
5,761,791 A 6/1998 Bando
5,821,638 A 10/1998 Boys et al.
5,828,940 A * 10/1998 Learman ..... 419/10
5,849,355 A 12/1998 McHenry
5,875,541 A 3/1999 Kumeji et al.
5,945,902 A 8/1999 Lipkes et al.
6,038,134 A 3/2000 Belter
6,054,914 A 4/2000 Abel et al.
6,107,907 A 8/2000 Leigh et al.
6,169,801 B1 1/2001 Levasseur
6,198,374 B1 3/2001 Abel
6,198,375 B1 3/2001 Shafer
6,204,744 B1 3/2001 Shafer et al.
6,287,931 B1 9/2001 Chen
6,293,001 B1 9/2001 Uriu et al.
6,366,192 B2 4/2002 Person et al.
6,379,579 B1 4/2002 Harada
6,392,525 B1 * 5/2002 Kato et al. ..... 336/233
6,420,953 B1 7/2002 Dadafshar
6,449,829 B1 9/2002 Shafer
6,460,244 B1 10/2002 Shafer et al.
6,566,731 B2 5/2003 Ahn et al.
6,593,841 B1 7/2003 Mizoguchi et al.
6,628,531 B2 9/2003 Dadafshar
6,631,545 B1 10/2003 Uriu et al.
6,653,196 B2 11/2003 Ahn et al.
6,658,724 B2 12/2003 Nakano et al.
6,720,074 B2 4/2004 Zhang et al.
6,749,827 B2 6/2004 Smalley et al.
6,750,723 B2 6/2004 Yoshida et al.
6,791,445 B2 9/2004 Shibata et al.
6,794,052 B2 9/2004 Schultz et al.
6,797,336 B2 9/2004 Garvey et al.
6,808,642 B2 10/2004 Takaya et al.
6,817,085 B2 11/2004 Uchikoba et al.
6,835,889 B2 12/2004 Hiraoka et al.
6,864,201 B2 3/2005 Schultz et al.
6,879,238 B2 4/2005 Liu et al.
6,882,261 B2 4/2005 Moro et al.
6,885,276 B2 4/2005 Iha et al.
6,888,435 B2 * 5/2005 Inoue et al. ..... 336/83
6,897,718 B2 5/2005 Yoshida et al.
6,908,960 B2 6/2005 Takaya et al.
6,927,738 B2 8/2005 Senba et al.
6,936,233 B2 8/2005 Smalley et al.
6,946,944 B2 9/2005 Shafer et al.
6,949,237 B2 9/2005 Smalley et al.
6,952,355 B2 10/2005 Riggio et al.
6,971,391 B1 12/2005 Wang et al.
6,979,709 B2 12/2005 Smalley et al.
6,986,876 B2 1/2006 Smalley et al.
6,998,939 B2 2/2006 Nakayama et al.
7,008,604 B2 3/2006 Smalley et al.
7,019,391 B2 3/2006 Tran
7,034,091 B2 4/2006 Schultz et al.
7,034,645 B2 4/2006 Shafer et al.
7,041,620 B2 5/2006 Smalley et al.
7,048,999 B2 5/2006 Smalley et al.
7,069,639 B2 7/2006 Choi et al.
7,071,406 B2 7/2006 Smalley et al.
7,078,999 B2 7/2006 Uriu et al.
7,081,803 B2 7/2006 Takaya et al.
7,087,207 B2 8/2006 Smalley et al.
7,091,412 B2 8/2006 Wang et al.
7,091,575 B2 8/2006 Ahn et al.
7,105,596 B2 9/2006 Smalley et al.
7,108,841 B2 9/2006 Smalley et al.
7,127,294 B1 10/2006 Wang et al.
7,142,066 B1 11/2006 Hannah et al.
7,162,302 B2 1/2007 Wang et al.
7,205,069 B2 4/2007 Smalley et al.
7,213,915 B2 5/2007 Tsutsumi et al.
7,221,249 B2 5/2007 Shafer et al.
7,262,482 B2 8/2007 Ahn et al.
7,263,761 B1 9/2007 Shafer et al.
7,294,366 B2 11/2007 Renn et al.
7,319,599 B2 1/2008 Hirano et al.
7,330,369 B2 2/2008 Tran
7,339,451 B2 3/2008 Liu et al.
7,345,562 B2 3/2008 Shafer et al.
7,354,563 B2 4/2008 Smalley et al.
7,375,417 B2 5/2008 Tran
7,380,328 B2 6/2008 Ahn et al.
7,390,477 B2 6/2008 Smalley et al.
7,390,767 B2 6/2008 Smalley et al.
7,393,699 B2 7/2008 Tran
7,400,512 B2 7/2008 Hirano et al.
7,419,624 B1 9/2008 Smalley et al.
7,419,651 B2 9/2008 Smalley et al.
7,442,665 B2 10/2008 Schultz et al.
7,445,852 B2 11/2008 Maruko et al.
7,481,989 B2 1/2009 Smalley et al.
7,485,366 B2 2/2009 Ma et al.
7,489,537 B2 2/2009 Tran
7,791,445 B2 9/2010 Manoukian et al.
8,378,777 B2 2/2013 Yan et al.
8,466,764 B2 6/2013 Bogert et al.
8,484,829 B2 7/2013 Manoukian et al.
8,910,373 B2 12/2014 Yan et al.
8,941,457 B2 1/2015 Yan et al.
2001/0016977 A1 8/2001 Moro et al.
2002/0009577 A1 1/2002 Takaya et al.
2002/0084880 A1 7/2002 Barbera-Guilem et al.
2003/0029830 A1 2/2003 Takaya et al.
2003/0048167 A1 * 3/2003 Inoue et al. ..... 336/200
2004/0113741 A1 6/2004 Li et al.
2004/0174239 A1 9/2004 Shibata et al.
2004/0209120 A1 10/2004 Inoue et al.
2004/0210289 A1 10/2004 Wang et al.
2005/0151614 A1 7/2005 Dadafshar
2005/0184848 A1 8/2005 Yoshida et al.
2005/0188529 A1 9/2005 Uriu et al.
2006/0038651 A1 2/2006 Mizushima et al.
2006/0145800 A1 7/2006 Dadafshar et al.
2006/0290460 A1 12/2006 Waffenschmidt et al.
2007/0030108 A1 2/2007 Ishimoto et al.
2007/0057755 A1 3/2007 Suzuki et al.
2008/0001702 A1 1/2008 Brunner
2008/0061917 A1 3/2008 Manoukian et al.
2008/0110014 A1 5/2008 Shafer et al.
2008/0278275 A1 11/2008 Fouquet et al.
2008/0310051 A1 12/2008 Yan et al.
2009/0302512 A1 12/2009 Gablenz et al.
2010/0007457 A1 1/2010 Yan et al.
2010/0026443 A1 2/2010 Yan et al.
2010/0039200 A1 2/2010 Yan et al.
2010/0085139 A1 4/2010 Yan et al.
2010/0171579 A1 7/2010 Yan et al.
2010/0171581 A1 7/2010 Manoukian et al.
2010/0259351 A1 10/2010 Bogert et al.
2010/0259352 A1 10/2010 Yan et al.
2010/0271161 A1 * 10/2010 Yan et al. ..... 336/83
2010/0271162 A1 * 10/2010 Yan et al. ..... 336/98
2010/0277267 A1 11/2010 Bogert et al.

FOREIGN PATENT DOCUMENTS

EP 1150312 A2 10/2001
EP 1288975 A2 3/2003
EP 1288975 A3 4/2003
EP 1564761 A1 8/2005
EP 1818950 A1 8/2007
EP 2561524 B1 9/2015
JP 60176208 9/1985
JP 07272932 3/1994
JP 2700713 1/1998
JP 10-106839 4/1998
JP 3108931 11/2000
JP 3160685 4/2001
JP 200118541 7/2001
JP 2002313632 10/2002

(56) References Cited

FOREIGN PATENT DOCUMENTS

| | | | |
|---|---|---|---|
| JP | 2003142871 | | 5/2003 |
| JP | 2007095829 | | 4/2007 |
| JP | 2008251735 | | 10/2008 |
| JP | 2008288370 | | 11/2008 |
| JP | 2009021549 | | 1/2009 |
| JP | 2009200435 | | 9/2009 |
| JP | 2009302386 | | 12/2009 |
| KR | 20010014533 | | 2/2001 |
| KR | 20020071285 | | 9/2002 |
| KR | 20030081738 | | 10/2003 |
| WO | 9205568 | | 4/1992 |
| WO | 9704469 | | 2/1997 |
| WO | 2006063081 | A2 | 6/2006 |
| WO | 2008033316 | | 3/2008 |
| WO | 2009113775 | A2 | 9/2009 |

OTHER PUBLICATIONS

International Preliminary Report on Patentability and Written Opinion of PCT/US2009/057471; Apr. 21, 2011; 6 pages.
International Search Report and Written Opinion of PCT/US2010/032787; Jul. 14, 2010; 20 pages.
International Search Report and Written Opinion of PCT/US2009/051005; Sep. 23, 2009; 15 pages.
International Search Report and Written Opinion of PCT/US2009/057471; Dec. 14, 2009; 14 pages.
Yoshida, S., et al.; Permeability and Electromagnetic-Interference Characteristics for Fe—Si—Al Alloy Flakes-Polymer Composite; Journal of Applied Physics; Apr. 15, 1999; pp. 4636-4638; vol. 85, No. 8; American Institute of Physics.
Kelley, A., et al; Plastic-Iron-Powder Distributed-Air-Gap Magnetic Material; Power Electronics Specialists Conference; 1990; PESC '90 Record; 21st Annual IEEE; Jun. 11-14, 1990; pp. 25-34; San Antonio, TX.
Heinrichs, F., et al.; Elements to Achieve Automotive Power; www.powersystemsdesign.com; Oct. 2004; pp. 37-40; Power Systems Design Europe.
EMI Suppression Sheets (PE Series); http://www.fdk.com.jp; 1 page.
Ferrite Polymer Composite (FPC) Film; http:// www.epcos.com/inf/80/ap/e0001000.htm; 1999 EPCOS; 8 pages.
VISA—Technology; http://130.149.207/visa-projekt/technology/technology.htm; Federal Ministry of Education and Research; Jan. 21, 2009. 1 page.
VISA—Overview; http://130.149.194.207/visa-projekt/index.htm; Federal Ministry of Education and Research; Jan. 23, 2009. 1 page.
Waffenschmidt, E.; VISA—The Concept; http://130.149.194.207/visa-projekt/technology/concept.htm; Federal Ministry of Education and Research; Jan. 21, 2009. 2 pages.
Waffenschmidt, E.; VISA—Ferrite Polymer Compounds; http://130.149.194.207/visa-projekt/technology/ferrite_polymers.htm; Federal Ministry of Education and Research; Jan. 21, 2009. 2 pages.
VISA—Literatur; http://130.149.194.207/visa-projekt/literatur.htm; Federal Ministry of Education and Research; Jan. 23, 2009. 11 pages.
Kim, S. et al; Electromagnetic Shielding Properties of Soft Magnetic Powder-Polymer Composite Films for the Application to Suppress Noise in the Radio Frequency Range; www.sciencedirect.com; Journal of Magnetism and Magnetic Materials 316 (2007) 472-474.
Notice of Second Office Action for Chinese Application No. 201180030923.6, Sep. 2, 2015, 4 pages.
Notice of First Office Action for Chinese Application No. 201180030923.6, Jan. 5, 2015, 15 pages.
Notice of Reasons for Rejection for Japanese Application No. 2013-506143, Sep. 1, 2015, 18 pages.
Notice of Reasons for Rejection for Japanese Application No. 2013-506143, Nov. 25, 2014, 4 pages.
Office Action for Taiwanese Application No. 100106563, Jul. 20, 2016, 3 pages.
Decision for Taiwanese Application No. 100106563, May 5, 2015, 4 pages.
Office Action for Taiwanese Application No. 100106563, Jan. 20, 2015, 11 pages.

* cited by examiner

LAMINATED MAGNETIC COMPONENT AND MANUFACTURE WITH SOFT MAGNETIC POWDER POLYMER COMPOSITE SHEETS

CROSS REFERENCE TO RELATED APPLICATIONS

This application relates in subject matter to U.S. patent application Ser. No. 11/519,349 filed Sep. 12, 2006 and now issued U.S. Pat. No. 7,791,445, and U.S. patent application Ser. No. 12/181,436 Filed Jul. 9, 2008 and now issued U.S. Pat. No. 8,378,777, the complete disclosures of which are hereby incorporated by reference in their entirety.

BACKGROUND OF THE INVENTION

The field of the invention relates generally to the construction and fabrication of miniaturized magnetic components for circuit board applications, and more specifically to the construction and fabrication of miniaturized magnetic components such as power inductors and transformers.

Recent trends to produce increasingly powerful, yet smaller electronic devices have led to numerous challenges to the electronics industry. Electronic devices such as smart phones, personal digital assistant (PDA) devices, entertainment devices, and portable computer devices, to name a few, are now widely owned and operated by a large, and growing, population of users. Such devices include an impressive, and rapidly expanding, array of features allowing such devices to interconnect with a plurality of communication networks, including but not limited to the Internet, as well as other electronic devices. Rapid information exchange using wireless communication platforms is possible using such devices, and such devices have become very convenient and popular to business and personal users alike.

For surface mount component manufacturers for circuit board applications required by such electronic devices, the challenge has been to provide increasingly miniaturized components so as to minimize the area occupied on a circuit board by the component (sometimes referred to as the component "footprint") and also its height measured in a direction parallel to a plane of the circuit board (sometimes referred to as the component "profile"). By decreasing the footprint and profile, the size of the circuit board assemblies for electronic devices can be reduced and/or the component density on the circuit board(s) can be increased, which allows for reductions in size of the electronic device itself or increased capabilities of a device with comparable size. Miniaturizing electronic components in a cost effective manner has introduced a number of practical challenges to electronic component manufacturers in a highly competitive marketplace. Because of the high volume of components needed for electronic devices in great demand, cost reduction in fabricating components has been of great practical interest to electronic component manufacturers.

In order to meet increasing demand for electronic devices, especially hand held devices, each generation of electronic devices need to be not only smaller, but offer increased functional features and capabilities. As a result, the electronic devices must be increasingly powerful devices. For some types of components, such as magnetic components that provide energy storage and regulation capabilities, meeting increased power demands while continuing to reduce the size of components that are already quite small, has proven challenging.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
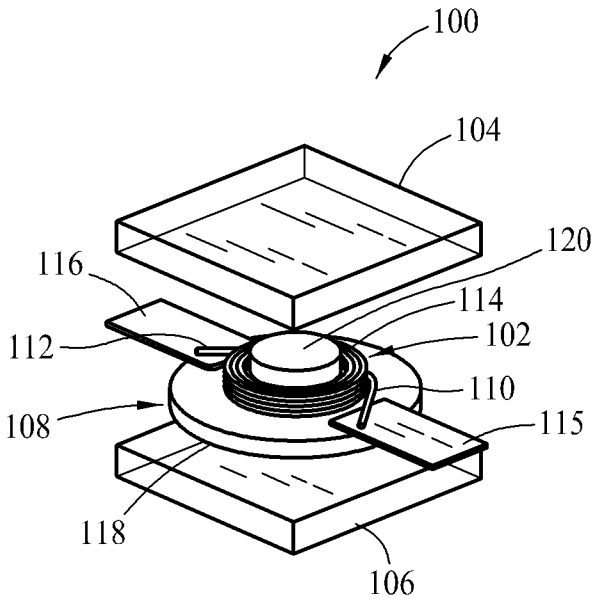
FIG. 1 is an exploded view of an exemplary magnetic component.

While conventional miniaturized magnetic components such as inductors and transformers have perhaps have been produced economically using known techniques, they have not met the performance requirements of higher powered devices. Likewise, constructions that are more capable of meeting higher performance requirements have not yet proven to be economically produced. Cost and/or performance issues of known magnetic component constructions for higher powered electronic devices have yet to be overcome in the art.

Historically, magnetic components such as inductors or transformers were assembled with separately fabricated magnetic core pieces that are assembled around a wire coil and physically gapped with respect to one another. Numerous problems exist when trying to miniaturize such components. In particular, achieving tightly controlled physical gaps in increasingly miniaturized components has proven difficult and expensive. An inability to control the physical gap creating also tends to create undesirability variability and reliability issues for miniaturized components.

To avoid difficulties with physically gapped core constructions for magnetic components, magnetic powder materials have been combined with binder materials to produce so-called distributed gap materials. Such material may be moldable into a desired shape and avoids any need for assembly of discrete core structures with physical gaps. Further, such material may be molded, in a semi-solid slurry form or as a granular insulated dry powder, directly around pre-fabricated coil structures to form a single piece core structure containing a coil. Mixing and preparing the magnetic powder and binder materials in a controlled and reliable manner, as well as controlling the molding steps, can be difficult, however, leading to increased costs of manufacturing magnetic components. This is perhaps more so for power inductors operating at comparatively higher current levels than conventional components. Increased performance requirements may require coil different coil configurations, different formulations of the moldable magnetic powder slurry or dry granular materials and/or tighter process controls in fabricating the components, any of which may increase the difficulty and cost of manufacturing such components.

Another known technique for producing miniaturized magnetic components is to form the components from thin layers of material to form a chip-type component. In conventional components of this type, dielectric layers of material, such as ceramic green sheet materials, have been used to form magnetic components. Conductive coil elements are typically formed or patterned on one or more of the dielectric layers and the coil elements are enclosed or embedded within the dielectric layers when assembled and formed. While very small components can be manufactured using such dielectric materials, they tend to provide limited performance capabilities. Processing the green sheets can further be intensive and relatively expensive for mass produced components. The ceramic sheets also have relatively poor heat transfer characteristics for higher current applications demanded by power inductors.

It has also been proposed to construct magnetic components from composite magnetic sheet materials arranged in layers. In components of this type, the layers are not only dielectric but also magnetic. That is, the sheet materials used as the layers exhibit a relative magnetic permeability $\mu_r$ of greater than 1.0 and are generally considered to be magnetically responsive materials. Such magnetically responsive sheet materials may include soft magnetic particles dispersed in a binder material, and are provided as freestanding thin layers or films that may be assembled in solid form, as opposed to semi-solid or liquid materials that are deposited on and supported by a substrate material, as the components are fabricated. As such, and unlike other composite magnetic materials known in the art, such freestanding thin layers or films are capable of being laminated.

Examples of laminated components utilizing composite magnetic sheet materials are disclosed in U.S. Published Patent Application No. 2010/0026443 A1. Such constructions can be beneficial in that the composite magnetic sheet materials can be prefabricated, and the layers can be pressure laminated around a conductive coil, which in turn may be pre-fabricated independently from any of the composite magnetic sheet materials. Lamination of the layers may be accomplished at relatively low cost and with less difficulty compared to other processes. Such constructions have nonetheless proven susceptible to performance limitations in certain aspects, and have not yet completely met the needs of higher powered, yet smaller sized, electronic devices. This is believed to be due to limitations in the composite magnetic sheet materials presently available.

Existing composite magnetic sheet materials have primarily been developed for electromagnetic shielding purposes, and have been utilized to construct magnetic components with this in mind. One such example of a component including composite magnetic sheets is described in KOKAI (Japanese Unexamined Patent Publication) No. 10-106839 entitled "Multilayer High-frequency Inductor". This reference teaches flat and/or acicular soft magnetic powder material that are intrinsically conductive materials, being kneaded into an insulating organic binder such that the soft magnetic powder is dispersed in the organic binder and formed into material layers that can be stacked to construct an inductor. The flat and/or acicular soft magnetic powder material is specifically compared and contrasted with nearly spherical magnetic powder materials. This reference teaches that a desirable magnetic anisotropy occurs if the soft magnetic powder is formed in at least one of the shapes of the soft magnetic powder of flat and acicular, in the high-frequency range, the magnetic permeability of the inductor, based on the magnetic resonance, increases. The reference concludes that the flat and/or acicular soft magnetic powder material is superior to spherical powder material for electromagnetic shielding, and when used to form a multilayer high-frequency inductor, separately provided shielding features can be eliminated and the size of the inductor component may be further reduced.

Published European Patent Application No. EP 0 785 557 A1 also discloses composite magnetic material sheets for electromagnetic shielding purposes. This reference, teaches two types of soft, flat magnetic particles and organic binder used to fabricate composite magnetic sheet materials having anisotropic properties. EP 0 785 557 A1 further discloses that polymer binders may be used to form the magnetic sheets, where the magnetic powder fills more than 90 weight percent of the completed solid sheet.

WO 2009/113775 discloses composite magnetic sheet materials utilized to construct a multilayer power inductor. This reference teaches sheets charged with soft magnetic metal powders wherein the soft magnetic powders are anisotropic and are arranged in parallel or perpendicular to the surface of the sheet. Surfaces of the sheets are patterned with circuit paths that are electrically connected by vias to define a conductive coil. Center areas of the sheets may have isotropic properties if desired, while the remaining areas of the sheets remain anisotropic. A fill factor for the magnetic powder sheet materials disclosed is about 80% or less by weight. Power inductor constructions of this type have proven to be limited in their performance capabilities for higher powered devices. Specifically, the direct current capacity of such constructions is below that required by newer electronic devices and applications.

A published paper entitled "Permeability and electromagnetic-interference characteristics of Fe—Si—Al alloy flakes-polymer composite", J. Appl. Phys. 85, 4636 (1999) is further believed to represent the state of the art of magnetic composite sheet materials. In this paper, noise suppression effects of an Fe—Si—Al alloy flakes-polymer composite are studied, and the properties of different types of sheets including anisotropic magnetic powders are compared. The paper concludes that magnetic permeability ($\mu$ max) of composite sheets made of Fe—Si—Al flakes (which has anisotropic properties) is superior to sheets made from atomized magnetic powder materials, and a much higher magnetic permeability is possible with the composite sheets made of Fe—Si—Al flakes.

Perhaps unexpectedly so, existing magnetic composite sheet materials, which have been refined considerably to provide desirable magnetic properties, are not effective to provide necessary performance capabilities for miniaturized components operable at increased current levels demanded by new electronic devices. To provide lower cost, yet high performance, laminated and miniaturized magnetic components such as power inductors and transformers operable at higher current levels, other types of magnetic composite sheet materials are needed.

Exemplary embodiments of inventive magnetic component constructions are described below utilizing enhanced magnetic composite sheet materials offering improved performance for higher current and power applications that is difficult, if not impossible, to achieve, using known magnetic composite sheet materials. Magnetic components such as power inductor and transformer components may be fabricated with reduced cost compared to other known power inductor constructions. Manufacturing methodology and steps associated with the devices described are in part apparent and in part specifically described below but are believed to be well within the purview of those in the art without further explanation.

FIGS. 1-7 illustrate a first exemplary embodiment of a magnetic component 100 including a coil 102 interposed between first and second magnetic composite sheets 104 and 106, and an optional magnetic core piece 108 assembled with the coil 102 and interposed between the first and second magnetic composite sheets 104 and 106.

The coil 102 is fabricated from a flexible wire conductor according to known techniques and includes a first end or lead 110, a second lead 112 (best seen in FIGS. 2-4), a winding portion 114 extending between the first and second leads 110, 112 and including a number of turns or loops. In the exemplary embodiment illustrated, the wire conductor used to fabricate the coil 102 has a round or circular cross section, although it may alternatively be flat or rectangular in cross section if desired. The coil 102 in the example shown is helically and spirally wound around a winding axis to form the winding portion 114 of a desired inductance value, for example. Precision winding techniques for fabricating the coil 102 are known and not described in further detail herein. The coil 102 may also optionally be provided with a layer of insulation using known techniques to prevent potential electrical shorting of the coil in use.

As those in the art will appreciate, an inductance value of the winding portion 114 depends primarily upon the number of turns of the wire, the specific material of the wire used to fabricate the coil 102, and the cross sectional area of the wire used to fabricate the coil 102. As such, inductance ratings of the magnetic component 100 may be varied considerably for different applications by varying the number of coil turns, the arrangement of the turns, and the cross sectional area of the coil turns. The tightly wound coil 102 as shown includes a relatively high number of turns in a compact configuration relative to conventional coils for used for miniaturized components. The inductance value of the component 100 can be therefore be increased considerably relative to other known miniaturized magnetic component constructions.

Optionally, and as shown in FIG. 1, terminal tabs 115 and 116 may be provided with each tab 115, 116 being connected to the respective coil leads 110, 112 via known soldering, welding or brazing techniques, or still other techniques known in the art. The tabs 115, 116 are generally planar and rectangular elements aligned with one another and arranged generally coplanar to one another as shown, although other geometries, arrangements and configurations of terminal elements are certainly possible. The terminal tabs 115, 116 are formed into surface mount terminations, described further below, as the component 100 is completed.

While the component 100 depicted is a power inductor component including one coil 102, it is contemplated that more than one coil 102 may likewise be provided. In a multiple coil embodiment, the coils may be connected in series or in parallel in an electrical circuit. Separate coils may likewise be arranged to form a transformer component instead of an inductor.

The magnetic composite sheets 104 and 106 are provided as a freestanding, solid sheet layers and may therefore be assembled rather easily, as contrasted with slurry or semi-solid materials, and liquid materials known in the art that are deposited on and supported by a substrate material for manufacturing purposes. The magnetic composite sheets 104 and 106 are flexible and amenable to lamination processes as described below.

Despite the accepted understanding of those in the art that shape anisotropy of magnetic powder particles is desirable in composite magnetic sheet constructions, Applicants believe that such shape anisotropy may actually be counterproductive for constructing magnetic components, including but not necessarily limited to higher current, miniaturized power inductors. That is, and perhaps unexpectedly so, the magnetic performance of certain magnetic components, of which the component 100 is one example, may actually be improved by utilizing magnetic composite sheets 104, 106 having no shape anisotropy, among other properties discussed below.

As those in the art will appreciate, shape anisotropy refers to the shape of the magnetic powder particles used to form the magnetic composite sheets 104 and 106. Highly symmetrical magnetic powder particles are considered to have no shape anisotropy, such that a given magnetic field magnetizes the powder particles to the same extent in all directions. Square particles and spherical particles are examples of particles having no shape anisotropy, although other symmetrical shapes are possible. While the size of the magnetic particles themselves may vary somewhat, a uniform shape of the particles in the magnetic composite sheets 104, 106 will provide no shape anisotropy. Alternatively stated, while the actual dimensions of the magnetic particles may not be equal, the aspect ratio (the ratio of a longest dimension to the shortest dimension in a three dimensional coordinate system) of the particles is generally uniform in the magnetic composite sheets 104, 106. It is possible that two or more different shapes of particles may have the same aspect ratio and provide no shape anisotropy in the magnetic composite sheets 104, 106 even if used in combination, but magnetic particles of different shapes having different aspect ratios, and perhaps even randomly distributed shapes and aspect ratios, would not provide magnetic composite sheets having no shape anisotropy.

As discussed above, and unlike the magnetic composite sheets 104 and 106, existing magnetic composite sheet materials are typically formulated and refined to provide a predetermined degree of shape anisotropy (i.e. having magnetic particles with elongated, highly asymmetrical shapes and large aspect ratios). Shape anisotropy is believed to attenuate, rather than improve, magnetic performance from a power magnetics perspective, and has until now presented practical performance limitations of magnetic components constructed from conventional, shape anisotropic magnetic composite sheets.

It should be recognized that while no shape anisotropy is believed to be beneficial in the magnetic composite sheets 104, 106, other forms of anisotropy exist and may be present in the magnetic composite sheets 104, 106 in further and/or alternative embodiments. For example, magnetocrystalline anisotropy may occur even in particles having no shape anisotropy. As another example, stress anisotropy may also exist to some extent. That is, while the magnetic composite sheets 104, 106 have no shape anisotropy, they may be anisotropic in another manner. Shape anisotropy, however, tends to be the dominant form of anisotropy when the magnetic powder particle sizes are small.

In various embodiments, soft magnetic powder particles used to make the magnetic composite sheets 104, 106 may include Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, and other suitable materials known in the art. Combinations of such magnetic powder particle materials may also be utilized if desired. The magnetic powder particles may be obtained using known methods and techniques. Optionally, the magnetic powder particles may be coated with an insulating material.

After being formed, the magnetic powder particles may be mixed and combined with a binder material. The binder material may be a polymer based resin having desirable heat flow characteristics in the layered construction of the component 100 for higher current, higher power use of the component 100. The resin may further be thermoplastic or thermoset in nature, either of which facilitates lamination of the sheet layers 104, 106 with heat and pressure. Solvents and the like may optionally be added to facilitate the composite material processing. The composite powder particle and resin material may be formed and solidified into a definite shape and form, such as the substantially planar and flexible thin sheets 104, 106 as shown. Specific methodology and techniques for making the magnetic sheets 104, 106 are known and not separately described herein. Much of the methodology and techniques for manufacturing existing composite magnetic sheets still applies, with the exception of the shape anisotropy as discussed above and some of the particulars in composition briefly explained below.

Various formulations of the magnetic composite materials used to form the sheets 104, 106 are possible to achieve varying levels of magnetic performance of the component 100 in use. In general, however, in a power inductor application, the magnetic performance of the material is generally proportional to the flux density saturation point (Bsat) of the magnetic particles used, the permeability (μ) of the magnetic particles, the loading (% by weight) of the magnetic particles in the composite, and the bulk density of the completed composite after being pressed around the coil as explained below. That is, by increasing the magnetic saturation point, the permeability, the loading and the bulk density a higher inductance will be realized and performance will be improved.

On the other hand, the magnetic performance of the component is inversely proportional to the amount of binder material used in the composite. Thus, as the loading of the composite of material with the binder material is increased, the inductance value of the end component tends to decrease, as well as the overall magnetic performance of the component. Each of Bsat and μ are material properties associated with the magnetic particles and may vary among different types of particles, while the loading of the magnetic particles and the loading of the binder may be varied among different formulations of the composite.

For inductor components, the considerations above can be utilized to strategically select materials and composite formulations to achieve specific objectives. As one example, metal powder materials may be preferred over ferrite materials for use as the magnetic powder materials in higher power indicator applications because metal powders, such as Fe—Si particles have a higher Bsat value. The Bsat value refers the maximum flux density B in a magnetic material attainable by an application of an external magnetic field intensity H. A magnetization curve, sometimes referred to as a B-H curve wherein a flux density B is plotted against a range of magnetic field intensity H may reveal the Bsat value for any given material. The initial part of the B-H curve defines the permeability or propensity of the material of the core 20 to become magnetized. Bsat refers to the point in the B-H curve where a maximum state of magnetization or flux of the material is established, such that the magnetic flux stays more or less constant even if the magnetic field intensity continues to increase. In other words, the point where the B-H curve reaches and maintains a minimum slope represents the flux density saturation point (Bsat).

Additionally, metal powder particles, such as Fe—Si particles have a relatively high level of permeability, whereas ferrite materials such as FeNi (permalloy) have a relatively low permeability. Generally speaking, a higher permeability slope in the B-H curve of the metal particles used, the greater the ability of the composite material to store magnetic flux and energy at a specified current level, which induces the magnetic field generating the flux.

In exemplary embodiments, the magnetic powder particles comprise at least 90% by weight percent of the composite. Additionally, the composite sheets 104, 106 may have a density of at least 3.3 grams per cubic centimeter, and an effective magnetic permeability of at least 10. The composite material is formed into the sheets 104, 106 so as not to create any physical voids or gaps in the sheets. As such, the sheets 104, 106 have distributed gap properties that avoid any need to create a physical gap in the component construction. The magnetic composite sheets 104, 106 when fully formed have insulating, dielectric, and magnetic properties. For the context of this discussion, the term "insulator" refers to a low degree of electrical conduction, and hence the sheets 104, 106 will not conduct electrical current in use. The term "dielectric" refers to a high polarizability (i.e., electric susceptibility) of the composite material in an applied electric field. The term "magnetic" refers to the degree of magnetization that the composite obtains in response to an applied magnetic field (i.e., magnetic permeability). Using such composite sheets 104 and 106, a power inductor having a large inductance value as well as a relatively large direct current capacity is possible for use in higher powered electronic devices of a smaller size.

Figure 2:
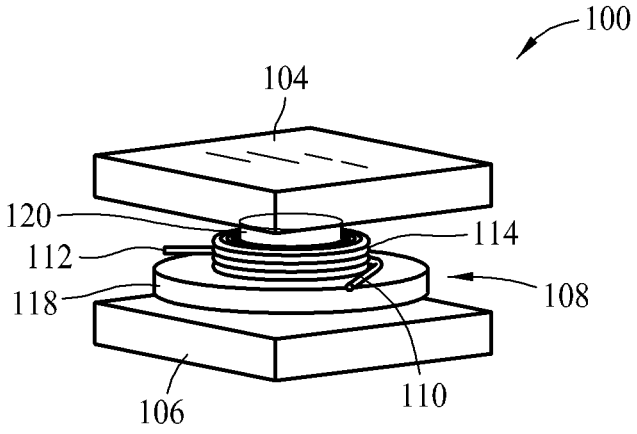
FIG. 2 is an assembly view of a portion of the component shown in FIG. 1.
Figure 3:
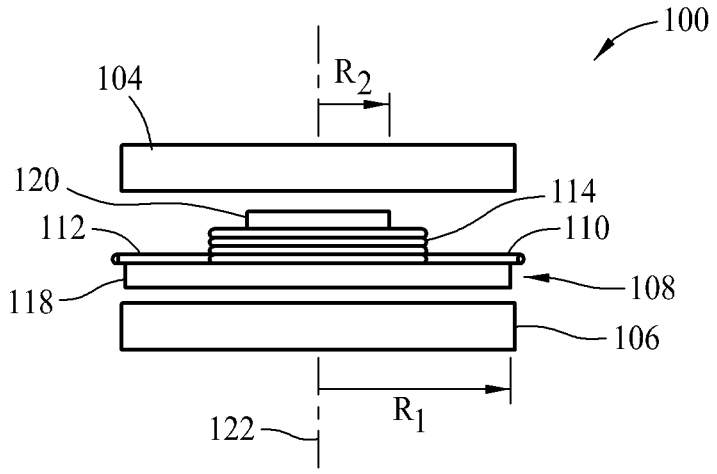
FIG. 3 is a side elevational view of the assembly shown in FIG. 2.

As previously mentioned, the magnetic composite sheets 104 and 106 are freestanding, flexible solid at room temperature, and definite in shape, as opposed to semi-solid and liquid materials known in the art having no definite shape. Accordingly, the magnetic composite sheets 104 and 106 may be manipulated, handled and assembled with definite shape to form magnetic components without having to use support substrates, deposition techniques and the like that semi-solid or liquid composite materials entail in other known magnetic component constructions. More specifically, and as shown in FIGS. 1-3, the composite sheets 104, 106 may be stacked as shown, either manually or in an automated procedure, and laminated in a rather simple and straightforward process compared to many existing miniaturized magnetic component constructions.

Two sheets 104, 106 are shown in the illustrative embodiment of FIGS. 1-7. As each sheet 104, 106 is relatively thin, as measured in a direction perpendicular to the plane of the sheets, an especially low profile magnetic component may result. It is understood, however, that more than two sheets 104, 106 may alternatively be utilized, albeit with an increased size of the completed component as additional sheets are added. It is also contemplated that a single sheet, such as the upper sheet 104 may be laminated to the coil 102 in certain embodiments without utilizing the lower sheet 106 or any other sheet. Also, while substantially square shaped sheets are shown, other geometric shapes of the magnetic composite sheets 104, 106 could alternatively be employed.

The magnetic core piece 108 is separately provided from the first and second composite sheets 104, 106. The magnetic core piece 108 may include a first portion 118 of a first dimension and a second portion 120 having a second dimension. In the example shown, the first portion 118 is generally annular or disk-shaped and has a first radius $R_1$ (FIG. 3) measured from a center axis 122 of the component 100 and the second portion 120 is generally cylindrical and has a second radius different $R_2$ that is substantially less than the first radius $R_1$. The second portion 120 extends upwardly from the first portion 118, and generally occupies an open center area of the coil winding portion 114. That is $R_2$ is substantially equal to an inner radius of the coil winding portion 114. The core piece 108 is sometimes referred to as a T-core, and may be recognized as such by those in the art.

The coil winding portion 114 seats or rests upon the first portion 118 of the magnetic piece. The radius $R_1$ of the first portion 118 in the example embodiment shown is relatively large so that the outer periphery of the first portion 118 is extends nearly completely between the opposed end edges of the sheets 104, 106 as best seen in FIG. 3. Except for the round shape of the first portion 118 of the core piece 108 and the square shape of the sheets 104 and 106, the magnetic core piece first portion 118 is substantially coextensive in area to the lower sheet 106 and provides a large contact area.

The second portion 120 having the lesser radius $R_2$, in contrast with the first portion 118, is not coextensive with the upper sheet 104 and a smaller contact area is provided. The plurality of turns in the coil winding portion 114 extend about the second portion 120 of the core piece 108, and the second portion 120 extends above the coil 102 for a short distance in a direction parallel to the axis 122 (FIG. 3). In one embodiment, the coil 102 is pre-wound and fitted over the core piece second portion 120 as the component 100 is assembled. The terminal tabs 115, 116 (FIG. 1) may assist in assembling the coil 102 to the core piece 108. In another embodiment, the coil 102 could be directly formed on and wound around the magnetic core piece.

The core piece 108 may be fabricated from ferrite, any of the magnetic powder particles disclosed above, or other appropriate magnetic material known in the art. The core piece 108 provides structural support to the coil 102 during lamination processes, assists in locating the coil 102 relative to the composite sheets 104, 106 and provides additional magnetic performance of the completed component 100, especially when the core piece 108 has a greater magnetic permeability than the composite sheets 104, 106. In such an embodiment, the higher direct current capacity of the coil 102 may therefore be coupled with the core piece 108 having a greater magnetic permeability for even greater inductance.

Figure 4:
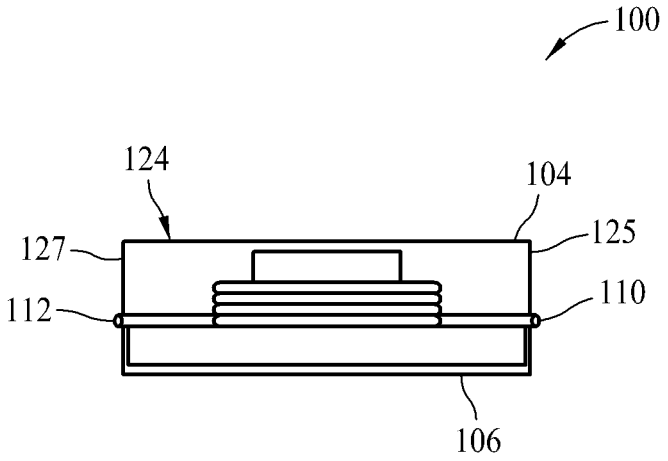
FIG. 4 is a side view of the assembly shown in FIG. 3 after lamination.
Figure 5:
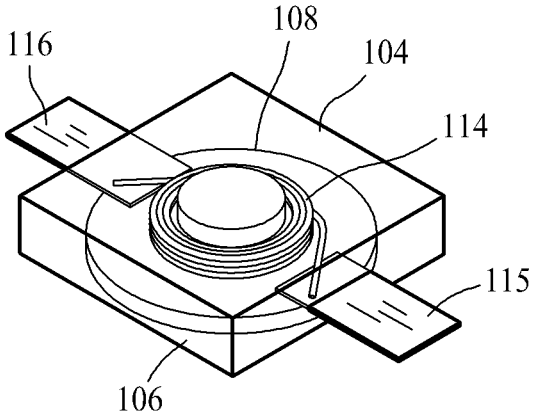
FIG. 5 is a perspective view of the assembly shown in FIG. 1 after lamination.
Figure 6:
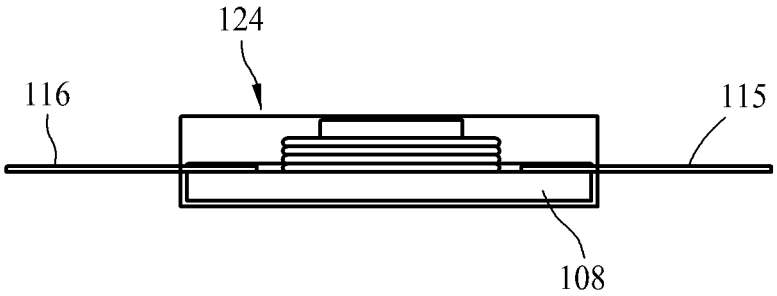
FIG. 6 is a side view of the laminated assembly shown in FIG. 5.
Figure 7:
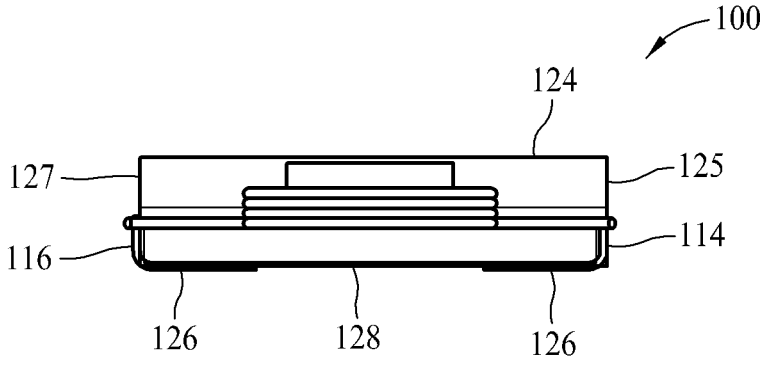
FIG. 7 is a side view of the laminated assembly shown in FIG. 6 and showing fully formed, surface mount terminations for the component.
Figure 8:
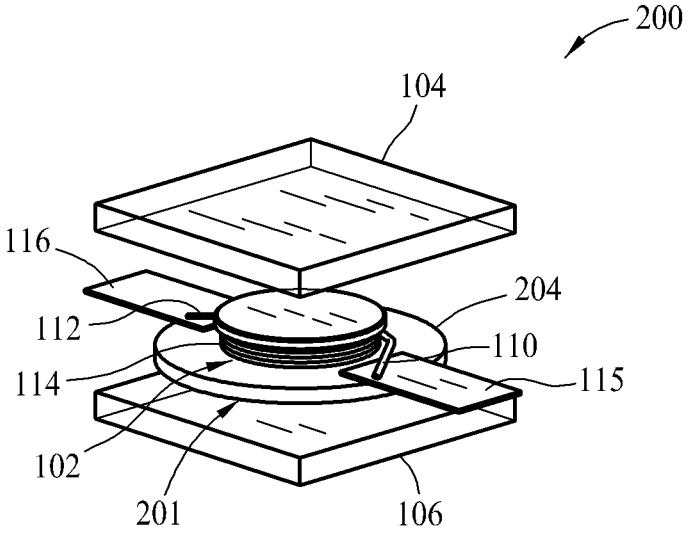
FIG. 8 is an exploded view of another exemplary magnetic component.
Figure 9:
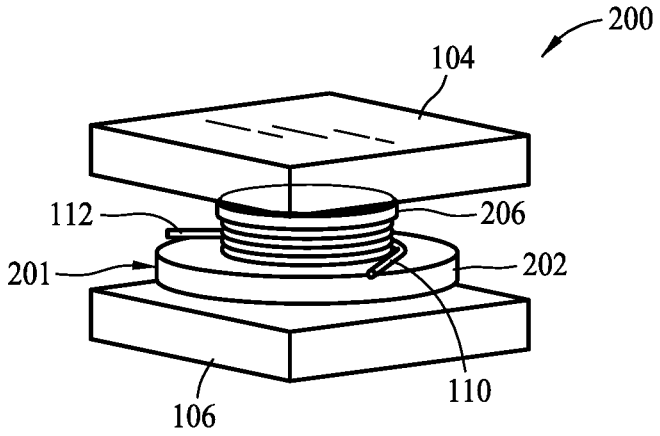
FIG. 9 is an assembly view of a portion of the component shown in FIG. 8.

Once the coil 102, the sheets 104 and 106, and the core piece 108 are assembled as shown in FIGS. 2 and 3, the assembly is laminated as shown in FIGS. 4-6. The sheets 104 and 106 are laminated to the coil 102 and the magnetic core piece 108 using pressure and perhaps heat depending on the particular binder used to form the sheets 104, 106. The flexible sheets 104 and 106 deform over the applicable surfaces of the comparatively rigid coil 102 and core piece 108 when compressed as shown in FIG. 4, while completely embedding the coil 102 and core piece 108 and defining a monolithic, single piece core structure 124 of the component 100 without any physical gaps. The core structure 124 is substantially square in the embodiment shown, although other shapes are possible.

As the sheets 104 and 106 deform and define the core structure 124 under compressive force, the thickness of the respective sheets 104 and 106 are changed in a non-uniform manner in the plane of each sheet, and also with respect to one another. That is, the sheets 104 and 106 are not necessarily deformed to the same extent in different areas of the sheet or in relation to one another. The sheets 104 and 106 meet one another and bond to one another in some areas of the component 100 (e.g., at the between the edge of the coil 102 and outer edges of the sheets 104 and 106) and the sheets 104 meet the outer surfaces of the coil 102 and core piece 108 and bond to them in other areas. Because of the geometry of the coil 102 and core piece 108 in a direction parallel to the axis 122 (FIG. 3), the thickness of the sheets 104 and 106, measured in a direction parallel to the axis 122, varies after lamination as shown in FIG. 4. In the examples shown, the thickness of the laminated core structure 124 is not equal to the sum of the thicknesses of the sheets 104 and 106 prior to lamination.

While the sheets 104 and 106 bond to one another where they meet as the core structure 124 is defined, the sheets 104 and 106 do not intermingle but rather remain as bonded layers in the construction. That is, while the bond line between the sheets 104 and 106 may be complex because of the geometries involved in laminating the sheets to the three dimensional coil 102 and core piece 108, the bond line still exists. In contrast, and for clarity, a construction wherein such corresponding layers did intermingle and mix to effectively become indistinguishable from one another would not form a laminate and would not constitute a lamination process for the purposes of the present invention. Specifically, layers that become fluidized and intermingled would not be laminated in the context of the present invention.

The assembled coil 102, sheets 104 and 106, and core piece 108 may be placed in a mold and laminated inside the mold to preserve the shape of the laminated component as seen in FIGS. 4 and 5, which may be rectangular as shown, although other shapes are possible. Because the magnetic composite sheets 104 and 106 are provided as solid flexible materials, however, no material needs to be pressure injected to the mold, and high temperatures associated with injection molding processes need not be involved. Rather, relatively simple compression molding of the solid materials, and perhaps some heating, is all that is required to complete the core structure 124. Elevated pressure and temperatures typically associated with injection molding processes are not required. Costs associated with generating, maintaining and controlling elevated temperatures and pressure conditions are accordingly saved.

As shown in FIGS. 5 and 6, when the terminal tabs 115 and 116 are provided, they extend from opposing side edges 125, 127 of the core structure 124 and are centrally located on the side edges 125, 127 of the core structure 124 from which they depend. Further, the terminal tabs 115, 116 project from the respective core structure side edges 125, 127 for a sufficient distance, extending perpendicular to the side edges 125 and 127 in the example shown, that they may be formed, bent, or otherwise extended around the side edges 125, 127 of the core structure 124 and portions of a bottom surface 128 of the core structure 124 to provide generally planar surface mount termination 126 on the bottom side of the component. When the terminations 126 are mounted to a circuit board, a circuit path may be completed from the board, through one of the terminations 126 to its respective coil lead 110 or 112, through the coil winding portion 114 to the other coil lead 110 or 112, and back to the board through the other termination 126. When so mounted to a circuit board, the component 100 may be configured as a power inductor or a transformer, depending on the particulars of the coil arrangement(s) used.

While the terminal tabs 115 and 116 are used to form the exemplary surface mount terminations 126 shown, surface mount terminations may alternatively be formed in another manner. For example, when the coil leads 110 and 112 are extended to the side edges 125 and 127 as shown in FIG. 4 when the component is laminated, other terminal structure can be attached to the coil leads 110 and 112. Various techniques are known in the art for providing surface mount terminations for printed circuit board applications, any of which may be used. The terminations 126 shown are provided solely for purposes of illustration, and with recognition that other termination techniques are known and may be utilized.

FIGS. 8-14 illustrate another embodiment of a magnetic component 200 similar in many aspects to the component 100 previously described. Like reference characters are therefore utilized for corresponding features in the embodiments 100 and 200. The reader is referred to the discussion above for the features of the component 200 that overlap with the features of the component 100.

A study of FIGS. 1-7 and FIGS. 8-14 will reveal that the difference between the components 100 and 200 is that the component 200 uses a different core piece 201 than the core piece 108.

The core piece 201, like the core piece 108, is separately provided from the first and second magnetic composite sheets 104, 106. The magnetic core piece 201 may include a first portion 202 of a first dimension, a second portion 204 (FIG. 10) having a second dimension, and a third portion 206 having a third dimension. In the example shown, the first portion 202 is generally annular or disk-shaped and has a first radius $R_1$ (FIG. 10) measured from a center axis 122 of the component 100 and the second portion 204 is generally cylindrical and has a second radius different R2 that is substantially less than the first radius R1. The second portion 204 extends upwardly from the first portion 202, and generally occupies an open center area of the coil winding portion 114. That is R2 is substantially equal to an inner radius of the coil winding portion 114.

The third portion 206 extends above the second portion 204, is generally annular or disk-shaped and has a third radius $R_3$ (FIG. 10) measured from a center axis 122 of the component 100. The third radius $R_3$ is greater than $R_2$ but less than $R_1$ such that the third portion 206 defines an overhanging flange relative to the second portion 204. The second portion 204, extending between the portions 202 and 206 each having a larger radius, thus defines a confined space or location for the winding portion 114 of the coil 102. The core piece 201 is sometimes referred to as a drum core, and may be recognized as such in the art.

Figure 10:
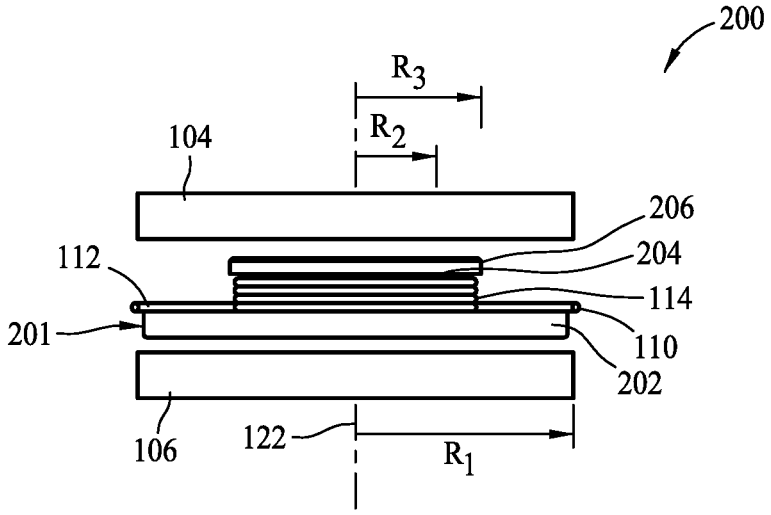
FIG. 10 is a side elevational view of the assembly shown in FIG. 9.
Figure 11:
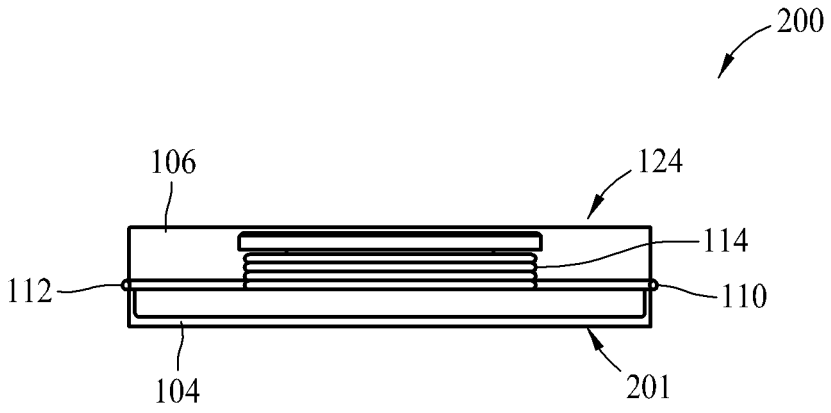
FIG. 11 is a side view of the assembly shown in FIG. 10 after lamination.
Figure 12:
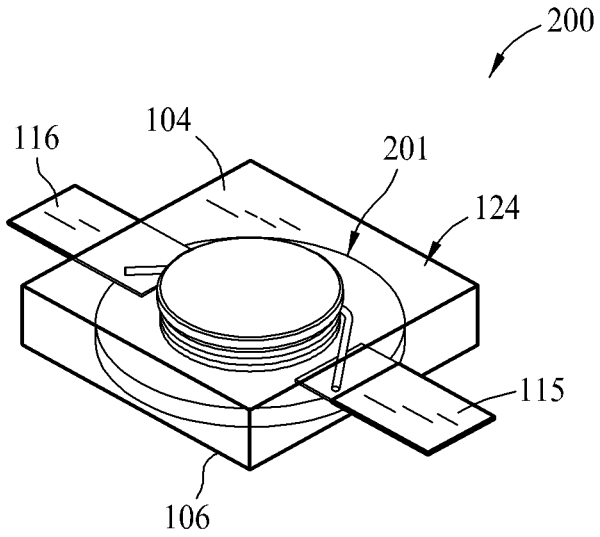
FIG. 12 is a perspective view of the assembly shown in FIG. 8 after lamination.
Figure 13:
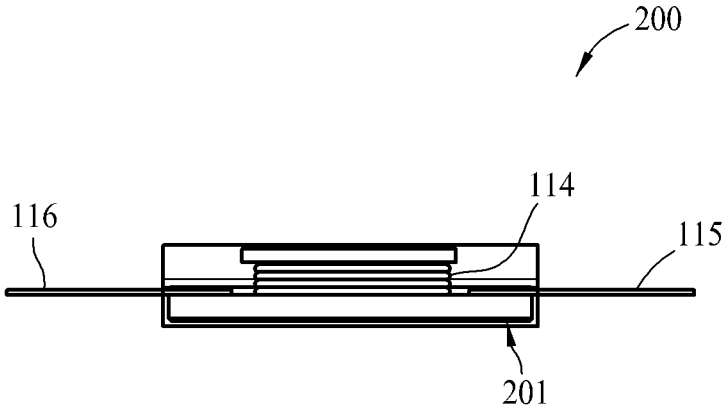
FIG. 13 is a side view of the laminated assembly shown in FIG. 12.
Figure 14:
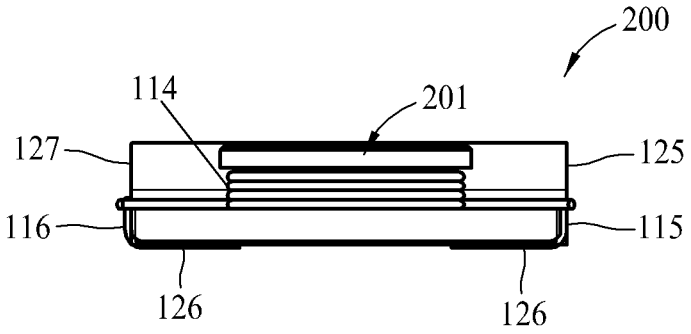
FIG. 14 is a side view of the laminated assembly shown in FIG. 13 and showing fully formed, surface mount terminations for the component.
Figure 15:
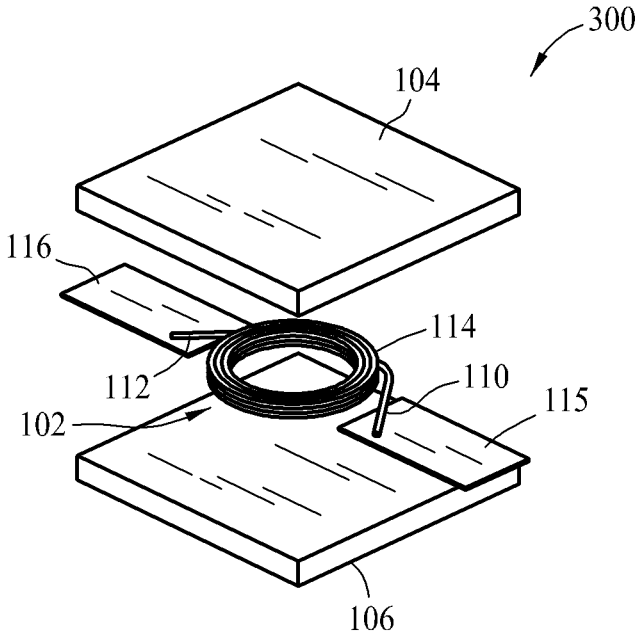
FIG. 15 is an exploded view of another exemplary magnetic component.
Figure 16:
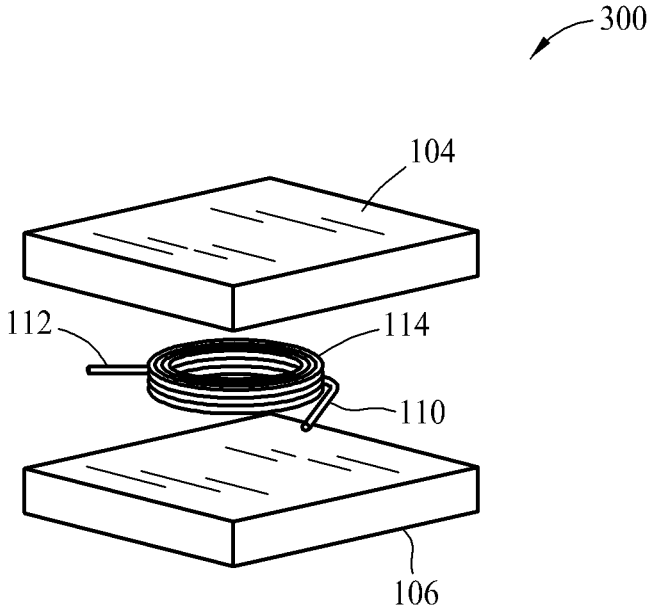
FIG. 16 is an assembly view of a portion of the component shown in FIG. 15.
Figure 17:
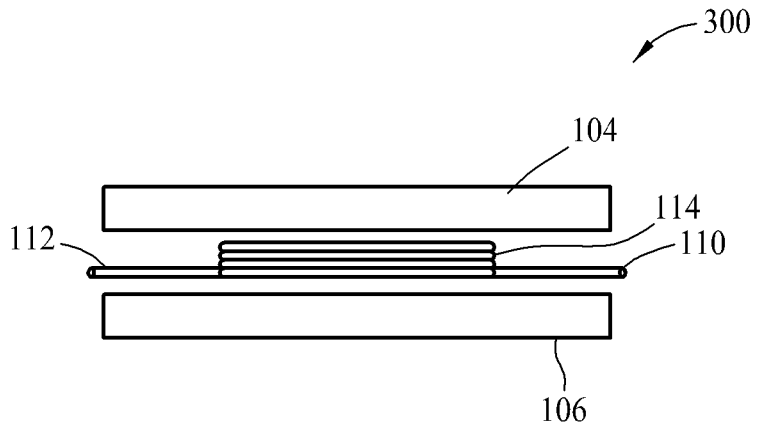
FIG. 17 is a side elevational view of the assembly shown in FIG. 16.
Figure 18:
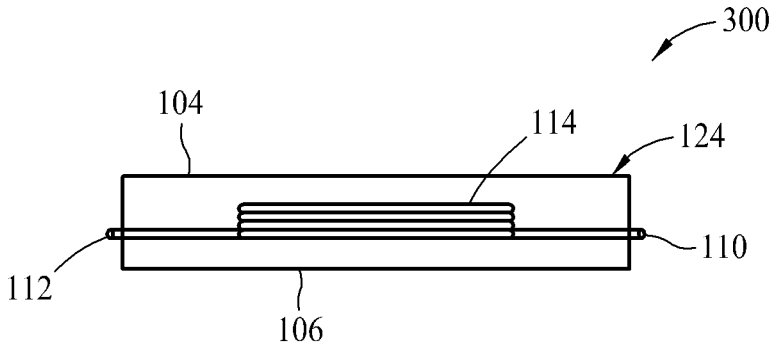
FIG. 18 is a side view of the assembly shown in FIG. 17 after lamination.
Figure 19:
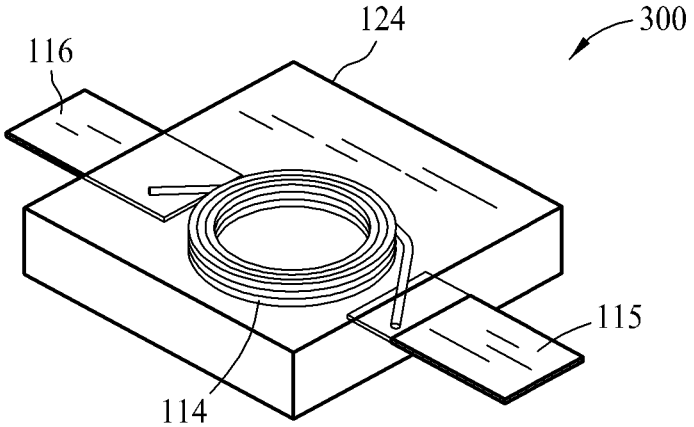
FIG. 19 is a perspective view of the assembly shown in FIG. 15 after lamination.
Figure 20:
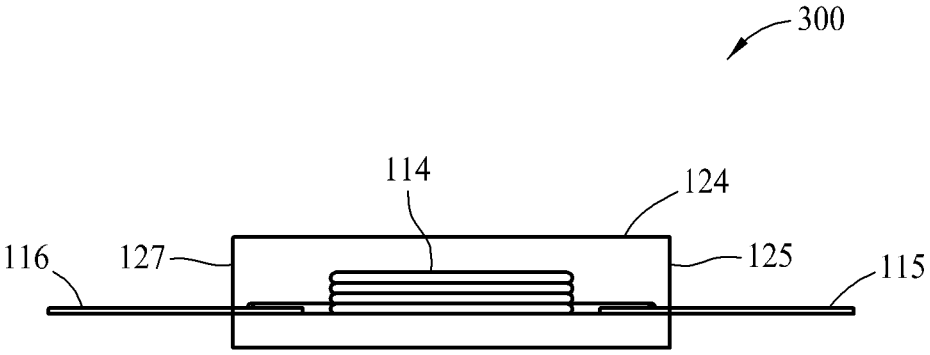
FIG. 20 is a side view of the laminated assembly shown in FIG. 18.

The coil winding portion 114 seats or rests upon the first portion 202 of the magnetic piece. The radius $R_1$ of the first portion 202 in the example embodiment shown is relatively large so that the outer periphery of the first portion 202 extends nearly completely between the opposed end edges of the sheets 104, 106 as best seen in FIG. 10. Except for the round shape of the first portion 202 of the core piece 201 and the square shape of the sheets 104 and 106, the magnetic core piece first portion 202 is substantially coextensive in area to the lower sheet 106 and provides a large contact area.

The second and third portions 204 and 206 having the lesser radiuses $R_2$ and $R_3$, in contrast with the first portion 118, are not coextensive with the upper sheet 104 and a smaller contact area is provided. The plurality of turns in the coil winding portion 114 extend about the second portion 204 of the core piece 201. The coil 102 may be directly formed on and wound around the drum core 201 such that the winding portion 114 is wound on the second portion 204. The winding 102 may be prefabricated on the drum core 201 and provided as a subassembly for manufacturing the component 200.

The core piece 201 may be fabricated from ferrite, any of the magnetic powder particles disclosed above, or other appropriate magnetic material known in the art. The core piece 201 provides structural support to the coil 102 during lamination processes, assists in locating the coil 102 relative to the composite sheets 104, 106 and provides additional magnetic performance of the completed component 200, especially when the core piece 201 has a greater magnetic permeability than the composite sheets 104, 106. In such an embodiment, the higher direct current capacity of the coil 102 may therefore be coupled with the core piece 201 having a greater magnetic permeability for even greater inductance.

Except for the core piece 201 used in lieu of the core piece 108, the manufacture of the component 200 is substantially the same as described above, with similar benefits and advantages.

FIGS. 15-20 illustrate another embodiment of a magnetic component 300 similar in most aspects to the components 100 and 200 as described, but omitting a separately provided core piece altogether. That is, neither the core pieces 108 nor the core piece 201 is utilized. In the component 300, the sheets 104 and 106 deform as they are compressed and occupy the open center area of the coil 102 and thus embed the coil around and within the open coil center. An acceptable magnetic component 300 may accordingly be provided for lower current applications, at reduced cost relative to other known miniaturized magnetic components. As previously mentioned, in certain embodiments the lower sheet 106 may be considered optional and only the upper sheet 104 may be laminated to the coil. Multiple magnetic composite sheets are not required in all contemplated embodiments of the invention.

The component 300 is otherwise similar in all aspects to the component 100 previously described. Like reference characters are therefore utilized for corresponding features in the embodiments 100 and 300. The reader is referred to the discussion above for the features of the component 300 that overlap with the features of the component 100.

By virtue of the dielectric, magnetic, and polymeric properties of the sheets 104 and 106 as described, miniaturized, low profile magnetic components such as power inductors may be provided with large inductance values as well as large direct current capacity that have heretofore been very difficult to manufacture in an economical manner, if at all. Similar benefits may accrue to other types of miniaturized magnetic components such as transformers.

The benefits and advantages of the invention are now believed to be amply disclosed in relation to the exemplary embodiments described.

A magnetic component has been disclosed including: at least one conductive wire coil including a first lead, a second lead, and a plurality of turns between the first and second lead; and at least one insulating, dielectric, and magnetic sheet comprising a composite mixture of soft magnetic powder particles with no shape anisotropy and a binder material, the composite being provided as a freestanding, solid sheet layer; wherein the at least one insulating, dielectric, and magnetic sheets is laminated to the coil, thereby defining a monolithic core structure embedding the at least one coil.

Optionally, the binder material may be one of a thermoplastic or thermoset resin. The resin may be polymer based. The at least one insulating, dielectric, and magnetic sheet may be laminated to the coil with at least one of heat and pressure. The magnetic powder particles may comprise at least 90 percent by weight of the mixture in the at least one insulating, dielectric, and magnetic sheet. An effective magnetic permeability of the at least one insulating, dielectric, and magnetic sheet may be at least 10. A density of the at least one insulating, dielectric, and magnetic sheet may be at least 3.3 grams per cubic centimeter. Terminal tabs may be coupled to each of the first and second leads. Surface mount terminations coupled to the respective first and second leads.

A magnetic core piece may be separately provided from the at least one sheet, with the plurality of turns extending about the magnetic core piece, and the at least one sheet being laminated to the coil and the magnetic core piece. The magnetic core piece may include a first portion having a first radius and a second portion having a second radius different from the first radius, with the second portion extending from the first portion and the plurality of turns extending about the second portion. The separately fabricated core piece may be a drum core, and the wire coil may be wound around the drum core.

The component may be a power inductor. The at least one insulating, dielectric, and magnetic sheet may include a first sheet and a second sheet, with each of the first and second sheets comprising a composite mixture of soft magnetic powder particles with no shape anisotropy and a binder material, the composite being provided as a freestanding, solid sheet layer; wherein the at least one coil is interposed between the first and second sheet, and wherein the first and second sheets are laminated to the coil and to one another to embed the at least one coil in a monolithic core structure.

Another embodiment of a magnetic component is also disclosed including: first and second insulating, dielectric, and magnetic sheets; at least one conductive wire coil including a first lead, a second lead, and a plurality of turns between the first and second lead; wherein the at least one conductive coil is interposed between the first and second insulating, dielectric, and magnetic sheets; wherein the first and second insulating, dielectric, and magnetic sheets are laminated to the coil to embed the coil therebetween and define a monolithic core structure without creating a physical gap; and the first and second insulating, dielectric, and magnetic sheets each comprising: a composite sheet including soft magnetic powder particles with no shape anisotropy and a polymer binder consisting of thermoplastic or thermoset resin which can be laminated with heat and pressure; the composite being provided as a freestanding, solid sheet layer; wherein a density of the composite is at least 3.3 grams per cubic centimeter; wherein the magnetic powder particles comprise at least 90% by weight percent of the composite; and wherein the effective magnetic permeability of the composite is at least 10.

The magnetic component may further include a magnetic core piece separately provided from the first and second sheets, with the plurality of turns extending about the magnetic core piece, and the first and second sheets being laminated to the coil and the separately fabricated core piece to form a monolithic core structure. The separately fabricated core piece may include a first portion having a first radius and a second portion having a second radius different from the first radius, with the second portion extending from the first portion and the plurality of turns extending about the second portion. The magnetic core piece may be a drum core, and the wire coil may be wound around the drum core. The magnetic component may further include surface mount terminations, and the component may be a power inductor.

An embodiment of a magnetic component is additional disclosed including: first and second insulating, dielectric, and magnetic sheet each comprising a composite being provided as a freestanding, solid sheet layer; at least one conductive wire coil including a first lead, a second lead, and a plurality of turns between the first and second lead; a magnetic core piece separately provided from the first and second insulating, dielectric and magnetic sheets; the plurality of turns extending about the magnetic core piece; wherein the at least one conductive coil and the magnetic core piece is interposed between the first and second insulating, dielectric, and magnetic sheets; wherein the first and second insulating, dielectric, and magnetic sheets are laminated to the coil and the magnetic core piece to embed the coil and the magnetic core piece and define a monolithic core structure without creating a physical gap; and surface mount terminations connected to the first and second coil leads.

The magnetic core piece may include a first portion having a first radius and a second portion having a second radius different from the first radius, with the second portion extending from the first portion and the plurality of turns extending about the second portion. The separately fabricated core piece may be a drum core, and the wire coil may be wound around the drum core. The composite may comprise: soft magnetic powder particles with no shape anisotropy; and a polymer binder consisting of thermoplastic or thermoset resin which can be laminated with heat and pressure; wherein a density of the composite is at least 3.3 grams per cubic centimeter; wherein the magnetic powder particles comprise at least 90% by weight of the composite; and wherein the effective magnetic permeability of the composite is at least 10. The component may be a power inductor.

A method of fabricating a magnetic component including a wire coil and at least one insulating, dielectric and magnetic sheet is also disclosed. The method includes: assembling at least one wire coil with the at least one insulating, dielectric and magnetic sheet layer; the at least one sheet comprising a composite provided as a freestanding, solid sheet layer, the composite including soft magnetic powder particles with no shape anisotropy; and laminating the at least one insulating, dielectric, and magnetic sheet to the at least one wire coil, thereby forming a monolithic core structure embedding the coil therein without a physical gap.

Optionally, assembling at least one wire coil with the at least one sheet may include: interposing at least one wire coil with first and second insulating, dielectric, and magnetic sheets each being a composite provided as a freestanding, solid sheet layer, the composite in each sheet including soft magnetic powder particles with no shape anisotropy; and laminating the first and second insulating, dielectric, and magnetic sheets to the at least one wire coil, thereby forming a monolithic core structure embedding the coil therein without a physical gap. The method may also include providing surface mount terminations connected to the first and second leads. The coil may include at least one conductive wire coil including a first lead, a second lead, and a plurality of turns between the first and second lead; and the component may further include a magnetic core piece separately provided from the at least one insulating, dielectric, and magnetic sheet, the method further comprising: extending the plurality of turns around a portion of the magnetic core piece; and laminating the at least one insulating, dielectric, and magnetic sheet to the coil and the magnetic core piece. Extending the plurality of turns around a portion of the magnetic core piece may include winding the coil around a drum core.

A product may be formed by the method, and the product may be a power inductor. The composite may further include: a polymer binder consisting of thermoplastic or thermoset resin which can be laminated with heat and pressure; wherein a density of the composite is at least 3.3 grams per cubic centimeter; wherein the magnetic powder particles comprise at least 90% by weight of the composite; and wherein the effective magnetic permeability of the composite is at least 10.

An embodiment of a magnetic component is also disclosed including: at least one conductive wire coil including a first lead, a second lead, and a plurality of turns between the first and second lead; and a magnetic composite material defining a monolithic core structure embedding the at least one coil without creating a physical gap; wherein the magnetic composite material includes metal powder particles with no shape anisotropy and a binder; wherein a density of the composite is at least 3.3 grams per cubic centimeter; wherein the metal powder particles comprise at least 90% by weight percent of the composite; and wherein the effective magnetic permeability of the composite is at least 10.

The monolithic core structure may be formed from at least one insulating, dielectric, and magnetic sheet laminated to the at least one coil. The at least one sheet may include first and second sheets, and the conductive coil is interposed between the first and second insulating, dielectric, and magnetic sheets.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A magnetic component comprising:

at least one conductive wire coil including a first lead, a second lead, and a plurality of turns between the first lead and the second lead; and at least one insulating, dielectric, and magnetic sheet comprising a composite mixture of soft magnetic powder particles with no shape anisotropy and a binder material, the composite being provided as a freestanding, solid sheet layer;

wherein the at least one insulating, dielectric, and magnetic sheet is laminated to the coil, thereby defining a monolithic core structure embedding the at least one coil.

2. The magnetic component of claim 1, wherein the binder material is one of a thermoplastic or thermoset resin.

3. The magnetic component of claim 2, wherein the resin is polymer based.

4. The magnetic component of claim 2, wherein the at least one insulating, dielectric, and magnetic sheet is laminated to the coil with at least one of heat and pressure.

5. The magnetic component of claim 1, wherein the magnetic powder particles comprise at least 90 percent by weight of the mixture in the at least one insulating, dielectric, and magnetic sheet.

6. The magnetic component of claim 1, wherein an effective magnetic permeability of the at least one insulating, dielectric, and magnetic sheet is at least 10.

7. The magnetic component of claim 1, wherein a density of the at least one insulating, dielectric, and magnetic sheet is at least 3.3 grams per cubic centimeter.

8. The magnetic component of claim 1, further comprising terminal tabs coupled to each of the first lead and the second lead.

9. The magnetic component of claim 1, further comprising surface mount terminations coupled to the respective first lead and the second lead.

10. The magnetic component of claim 1, further comprising a magnetic core piece separately provided from the at least one sheet, the plurality of turns extending about the magnetic core piece, and the at least one sheet being laminated to the coil and the magnetic core piece.

11. The magnetic component of claim 10, wherein the magnetic core piece comprises a first portion having a first radius and a second portion having a second radius different from the first radius, the second portion extending from the first portion and the plurality of turns extending about the second portion.

12. The magnetic component of claim 11, wherein the separately fabricated core piece comprises a drum core, and the wire coil is wound around the drum core.

13. The magnetic component of claim 1, wherein the component is a power inductor.

14. The magnetic component of claim 1, wherein the at least one insulating, dielectric, and magnetic sheet comprises a first sheet and a second sheet, each of the first and second sheets comprising a composite mixture of soft magnetic powder particles with no shape anisotropy and a binder material, the composite being provided as a freestanding, solid sheet layer;

wherein the at least one coil is interposed between the first and second sheet, and wherein the first and second sheets are laminated to the coil and to one another to embed the at least one coil in a monolithic core structure.

15. A magnetic component comprising:

first and second insulating, dielectric, and magnetic sheets;

at least one conductive wire coil including a first lead, a second lead, and a plurality of turns between the first lead and the second lead;

wherein the at least one conductive coil is interposed between the first and second insulating, dielectric, and magnetic sheets;

wherein the first and second insulating, dielectric, and magnetic sheets are laminated to the coil to embed the coil therebetween and define a monolithic core structure without creating a physical gap; and the first and second insulating, dielectric, and magnetic sheets each comprising:

a composite sheet including soft magnetic powder particles with no shape anisotropy and a polymer binder consisting of thermoplastic or thermoset resin which can be laminated with heat and pressure;

the composite being provided as a freestanding, solid sheet layer;

wherein a density of the composite is at least 3.3 grams per cubic centimeter;

wherein the magnetic powder particles comprise at least 90% by weight percent of the composite; and wherein the effective magnetic permeability of the composite is at least 10.

16. The magnetic component of claim 15, further comprising a magnetic core piece separately provided from the first and second sheets, the plurality of turns extending about the magnetic core piece, and the first and second sheets being laminated to the coil and the separately fabricated core piece to form a monolithic core structure.

17. The magnetic component of claim 16, wherein the separately fabricated core piece comprise a first portion having a first radius and a second portion having a second radius different from the first radius, the second portion extending from the first portion and the plurality of turns extending about the second portion.

18. The magnetic component of claim 17, wherein the magnetic core piece comprises a drum core, the wire coil being wound around the drum core.

19. The magnetic component of claim 15, further comprising surface mount terminations.

20. The magnetic component of claim 19, wherein the component is a power inductor.

21. A magnetic component comprising:

first and second insulating, dielectric, and magnetic sheets each comprising a composite being provided as a freestanding, solid sheet layer;

at least one conductive wire coil including a first lead, a second lead, and a plurality of turns between the first and second lead;

a magnetic core piece separately provided from the first and second insulating, dielectric and magnetic sheets;

the plurality of turns extending about the magnetic core piece;

wherein the at least one conductive coil and the magnetic core piece is interposed between the first and second insulating, dielectric, and magnetic sheets;

wherein the first and second insulating, dielectric, and magnetic sheets are laminated to the coil and the magnetic core piece to embed the coil and the magnetic core piece and define a monolithic core structure without creating a physical gap; and surface mount terminations connected to the first and second coil leads.

22. The magnetic component of claim 21, wherein the magnetic core piece comprise a first portion having a first radius and a second portion having a second radius different from the first radius, the second portion extending from the first portion and the plurality of turns extending about the second portion.

23. The magnetic component of claim 22, wherein the separately fabricated core piece comprises a drum core, and the wire coil is wound around the drum core.

24. The magnetic component of claim 21, wherein the composite comprises:

soft magnetic powder particles with no shape anisotropy; and a polymer binder consisting of thermoplastic or thermoset resin which can be laminated with heat and pressure;

wherein a density of the composite is at least 3.3 grams per cubic centimeter wherein the magnetic powder particles comprise at least 90% by weight of the composite; and wherein the effective magnetic permeability of the composite is at least 10.

25. The component of claim 21, wherein the component is a power inductor.

26. A magnetic component comprising:

at least one conductive wire coil including a first lead, a second lead, and a plurality of turns between the first lead and the second lead; and a magnetic composite material defining a monolithic core structure embedding the at least one coil without creating a physical gap;

wherein the magnetic composite material includes metal powder particles with no shape anisotropy and a binder;

wherein a density of the composite is at least 3.3 grams per cubic centimeter;

wherein the metal powder particles comprise at least 90% by weight percent of the composite; and wherein the effective magnetic permeability of the composite is at least 10.

27. The magnetic component of claim 26, wherein the monolithic core structure is formed from at least one insulating, dielectric, and magnetic sheet laminated to the at least one coil.

28. The magnetic component of claim 26, wherein the at least one sheet comprises first and second sheets, and the conductive coil is interposed between the first and second insulating, dielectric, and magnetic sheets.

* * * * *